US006978647B2

(12) United States Patent
Edwards, Jr. et al.

(10) Patent No.: US 6,978,647 B2
(45) Date of Patent: Dec. 27, 2005

(54) PICK-RESISTANT WAFER TUMBLER LOCK WITH SIDEBARS

(75) Inventors: Billy B. Edwards, Jr., Brookfield, WI (US); James L. Welch, Waukesha, WI (US)

(73) Assignee: Master Lock Company, Oak Creek, WI (US)

( * ) Notice: Subject to any disclaimer, the term of this patent is extended or adjusted under 35 U.S.C. 154(b) by 0 days.

(21) Appl. No.: 10/187,727

(22) Filed: Jul. 2, 2002

(65) Prior Publication Data

US 2003/0037582 A1 Feb. 27, 2003

Related U.S. Application Data

(60) Provisional application No. 60/302,643, filed on Jul. 2, 2001.

(51) Int. Cl.[7] ..... E05B 29/04
(52) U.S. Cl. ..... 70/495
(58) Field of Search ..... 70/494–496, 492, 70/493

(56) References Cited

U.S. PATENT DOCUMENTS

| | | | | |
|---|---|---|---|---|
| 1,906,701 A | | 5/1933 | Maxwell | |
| 1,915,897 A | | 6/1933 | Maxwell | |
| 1,965,336 A | | 7/1934 | Fitz Gerald | |
| 2,024,441 A | | 12/1935 | Fitz Gerald | |
| 2,123,940 A | * | 7/1938 | Gray | |
| 2,405,911 A | | 8/1946 | Swanson | |
| 2,426,104 A | | 8/1947 | Johnstone | |
| 2,460,551 A | | 2/1949 | Swanson | |
| 2,687,639 A | * | 8/1954 | Swanson | |
| 2,949,762 A | | 8/1960 | Johnston | |
| 3,002,268 A | | 10/1961 | Spain | |
| 3,035,433 A | * | 5/1962 | Testa | |
| 3,455,130 A | | 7/1969 | Basseches | |
| 3,479,848 A | | 11/1969 | Golden | |
| 3,854,311 A | | 12/1974 | Mercurio | |
| 3,985,010 A | | 10/1976 | Idoni | 70/378 X |
| 3,999,413 A | * | 12/1976 | Raymond et al. | 70/419 X |
| 4,015,458 A | | 4/1977 | Mercurio | 70/377 X |
| 4,085,601 A | | 4/1978 | Sauder | 70/377 X |
| 4,292,823 A | * | 10/1981 | Reinhard et al. | 70/419 X |
| 4,356,713 A | | 11/1982 | Widen | 70/358 X |
| 4,711,106 A | | 12/1987 | Johnson | 70/34 |
| 4,750,342 A | | 6/1988 | Nakai | 70/377 X |
| 4,977,767 A | * | 12/1990 | Prunbauer | 70/406 |
| 5,001,914 A | | 3/1991 | Edwards | 70/495 |
| 5,134,871 A | * | 8/1992 | Makino et al. | 70/492 |

(Continued)

FOREIGN PATENT DOCUMENTS

FR 2279911 A1 2/1976

(Continued)

*Primary Examiner*—Lloyd A. Gall
(74) *Attorney, Agent, or Firm*—Calfee, Halter & Griswold LLP

(57) ABSTRACT

The invention provides a pick-resistant locking mechanism with wafer tumblers, sidebars and an interchangeable cylinder that allows re-keying of the lock. The sidebars have projections with beveled sides that engage with cavities in the lock shell when rotational torque is applied to the lock in the absence of the correct key. A sidebar of the lock contacts two, nonadjacent wafer tumblers. The wafer tumblers have indentations that engage cavities in the lock shell when rotational torque is applied during picking of the lock. Tolerance between sidebars and the lock shell is less than the tolerance between tumblers and the lock shell. The tumbler springs are not accessible from the keyway of the lock and are more powerful than the sidebar springs.

10 Claims, 14 Drawing Sheets

U.S. PATENT DOCUMENTS

| | | | | | |
|---|---|---|---|---|---|
| 5,209,087 | A | * | 5/1993 | Cox | 70/369 |
| 5,375,444 | A | * | 12/1994 | Smith | 70/495 |
| 5,454,246 | A | | 10/1995 | Mueller | 70/495 |
| 5,475,998 | A | * | 12/1995 | Raskevicius et al. | 70/495 |
| 5,611,225 | A | * | 3/1997 | Resch et al. | 70/422 |
| 5,709,115 | A | * | 1/1998 | Richter | 70/495 |
| 5,826,451 | A | * | 10/1998 | Cook | 70/495 |
| 5,956,986 | A | * | 9/1999 | Vonlanthen | 70/492 |
| 5,964,107 | A | | 10/1999 | Chang | |
| 6,427,506 | B1 | * | 8/2002 | Prunbauer | 70/495 |
| 6,564,601 | B2 | * | 5/2003 | Hyatt Jr. | 70/278.3 |

FOREIGN PATENT DOCUMENTS

| | | | | |
|---|---|---|---|---|
| FR | 2410718 | * | 8/1979 | 70/495 |
| GB | 607199 | | 8/1948 | |
| GB | 2041061 A | | 9/1980 | |
| JP | 5351100 | | 5/1978 | |
| JP | 1278668 | | 11/1989 | |
| JP | 1299968 | | 12/1989 | |
| JP | 3047380 | | 2/1991 | |
| JP | 4198572 | | 7/1992 | |

* cited by examiner

FIG. 9
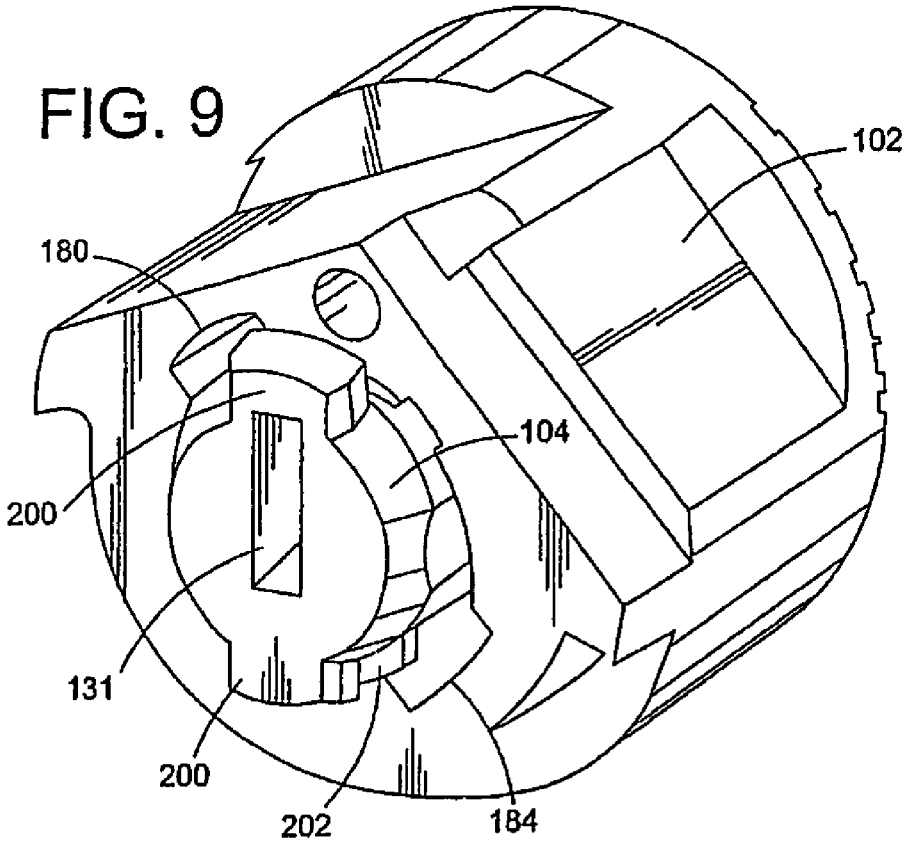
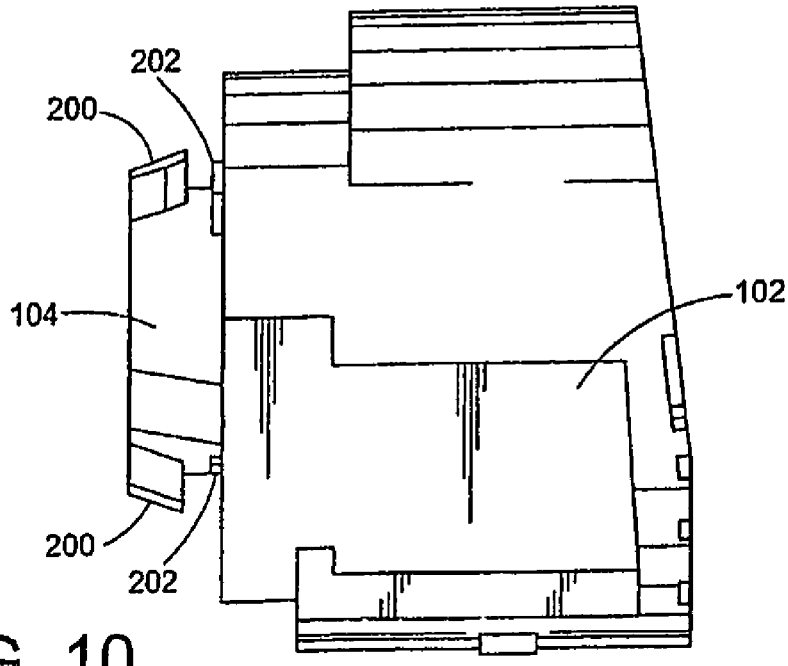
FIG. 10

PICK-RESISTANT WAFER TUMBLER LOCK WITH SIDEBARS

CROSS-REFERENCE TO RELATED APPLICATIONS

This invention claims priority to U.S. Provisional Patent Application Ser. No. 60/302,643, filed Jul. 2, 2001.

FIELD OF THE INVENTION

The invention relates to a pick-resistant locking mechanism, and more specifically to a locking mechanism with wafer tumblers and sidebars that interact to provide pick-resistant features.

BACKGROUND OF THE INVENTION

Pin-tumbler locking mechanisms contain a cylinder plug which rotates within a tightly-fitting cylindrical housing or shell. Channels containing elongated top and bottom pin tumblers extend perpendicularly through the cylinder plug and shell. The pin tumblers slide up and down within the channels to provide for a locked and unlocked position. When the top or bottom pin tumbler spans both the cylinder plug and shell, the pin tumbler is in a position of interference and the cylinder plug is locked and therefore unable to rotate within the shell. When the correct key is inserted into the keyway of the lock, the notches on the key contact the bottom pin tumblers and slide the pin tumblers within the channels so that the entire length of the bottom pin tumbler is positioned within the cylinder plug at its outside diameter. As such, the pin tumblers are in a position of non-interference, and the cylinder plug is unlocked thereby allowing the cylinder plug to rotate within the shell when rotational torque is applied by the key.

Locks can be picked, or opened without a key. FIGS. 1A–1G illustrate one conventional lock picking technique. As shown in FIG. 1, a lock housing or shell A is provided with a rotateable cylinder plug B housed therein. A set of channels C extend through the shell A and cylinder plug B and contain spring-loaded pin tumblers D. In the locking mechanism shown in FIG. 1, the pin tumblers D have two parts which can separate when aligned along the shear line E by the correct key (not shown). In order to pick the lock, a tension wrench F is inserted into the keyway G of the lock, as shown in FIG. 1B, and rotational torque is applied to the cylinder plug B. Since the pins D are in a position of interference with the cylinder plug B and shell A, the cylinder plug B is unable to rotate within the shell A. However, due to imperfections and misalignments in the mechanism, the torque applied by the tension wrench F can cause slight rotation of the cylinder plug B which results in small offsets between the channels C in the cylinder plug B and the shell A. This offsetting of the channels C creates a ledge along the surface of the channels C along the shear line E. A pick H is then inserted into the keyway G and used to slide one of the pin tumblers D up its respective channel C so that the end of the pin tumbler D rests on the ledge created along the shear line E, as shown in FIG. 1C. Continued application of the rotational torque causes the pin tumbler D to remain wedged in this position of non-interference. As shown in FIGS. 1D–1F, the pick H is then used to position each of the other pin tumblers D on the ledge one at a time. As shown in FIG. 1G, once all of the pin tumblers D are positioned on the ledge, the cylinder plug B can rotate within the shell A, thereby allowing the locking mechanism to be unlocked.

An alternative to the pin-tumbler lock is the wafer-tumbler locking mechanism. Wafer-tumbler locks require less strict tolerances between components and, therefore, are advantageous in that they are more economical to manufacture than pin tumbler locks. Wafer tumbler locks have thin wafer-shaped tumblers which slide up and down within slots that span both the cylinder plug and shell. The wafer tumblers are spring loaded so that they extend out of the cylinder plug and into a cavity within the lock shell. In this position of interference, the extended wafer tumblers prevent rotation of the cylinder plug within the shell. The center of each of the wafer tumblers has an opening so that a key can be inserted into the keyway and through the wafer tumblers. The correct key contacts the wafer tumblers and moves the wafer tumblers within the slots so that they are retracted from the cavity within the lock shell and positioned within the cylinder plug. So positioned, the wafer tumblers are in a position of non-interference and rotational torque applied to the cylinder plug causes its rotation within the shell and unlocking of the mechanism. Insertion of an incorrect key into the lock keyway will not result in placement of the wafer tumblers in a position of non-interference.

Since wafer tumbler locks are easier to pick, its resistance to picking can be increased by placing a second locking feature within the lock. One such locking feature that has been used in the past is a spring-loaded sidebar. A sidebar is positioned within its own slot in the cylinder plug, the slot cut perpendicular to the slot within which the wafer-tumblers slide. Positioned within a sidebar slot, a sidebar can contact a wafer tumbler. Two types of sidebar can be used, those that are sprung away from the tumblers and those that are sprung toward the tumblers. There are distinct advantages to using the type that is sprung toward the tumblers. For example, a sidebar that is sprung away from the tumblers can be forced into the tumblers and into a position of non-interference by the application of rotational torque. On the other hand, a sidebar that is sprung toward the tumblers will not seat properly in the tumbler upon the application of rotational torque. When the wafer tumbler is in a position of interference, the wafer tumblers contact with the sidebar prevents the sidebar from withdrawing from the cavity within the shell. So positioned, the sidebar spans the cylinder plug and shell and keeps the cylinder plug from rotating within the shell. When the wafer tumbler is in a position of non-interference, the wafer tumbler contact with the sidebar is changed such that the sidebar is no longer held within the cavity of the shell and therefore does not span the cylinder plug and shell. When the sidebar is so positioned, rotational torque causes the cylinder plug to rotate within the shell.

Although wafer-tumbler locks are more economical to produce and are of smaller size than some other tumbler locking mechanisms, pin-tumbler locks for example, they are typically less resistant to picking than pin-tumbler locks. There is a need for a wafer-tumbler locking mechanism that is more pick-resistant.

SUMMARY OF THE INVENTION

A pick-resistant locking mechanism including wafer tumblers and sidebars is provided. In one embodiment, the sidebars have projections with beveled sides that engage with cavities in the lock shell when rotational torque is applied in the absence of the correct key. The tolerance between the sidebar and the lock shell is less than the tolerance between tumblers and the lock shell. When rotational torque is applied in the absence of the correct key, the tolerance difference provides for engagement of the sidebar projections with the cavities of the lock shell before tumblers engage with the lock shell.

In another embodiment, each sidebar contacts two, non-adjacent wafer tumblers. An important aspect of the present invention is that the tumbler springs are not accessible from the keyway of the lock. In such an arrangement, the tumbler springs cannot be displaced, thereby allowing movement of the tumblers, by an attack from the keyway. Furthermore, in one embodiment, the tumbler springs are more powerful than the sidebar springs making it impossible to align the tumbler cutout for the sidebar with the projection on the sidebar without continuous support of the tumbler in the proper position. Additionally, tumbler indentations may be included to engage shell projections when rotational torque is applied to the cylinder in the absence of the correct key.

Another aspect of the present invention is a pick-resistant wafer cylinder lock that includes an interchangeable cylinder that allows rapid re-keying of the lock by swapping of one cylinder for another.

Still, other advantages and benefits of the invention will be apparent to those skilled in the art upon reading and understanding of the following detailed description.

BRIEF DESCRIPTION OF THE DRAWINGS

The present invention may be more readily understood by reference to the following drawings. While certain embodiments are shown as illustrative examples of the invention, the scope of this application should not be construed as limited to these illustrative examples.

FIG. 9 is a view of the cylinder assembly fully inserted and partially rotated within the shell of the wafer lock; and FIG. 10 is a top view of the cylinder assembly shown in FIG. 9.

DETAILED DESCRIPTION OF THE INVENTION

Figure 1A:
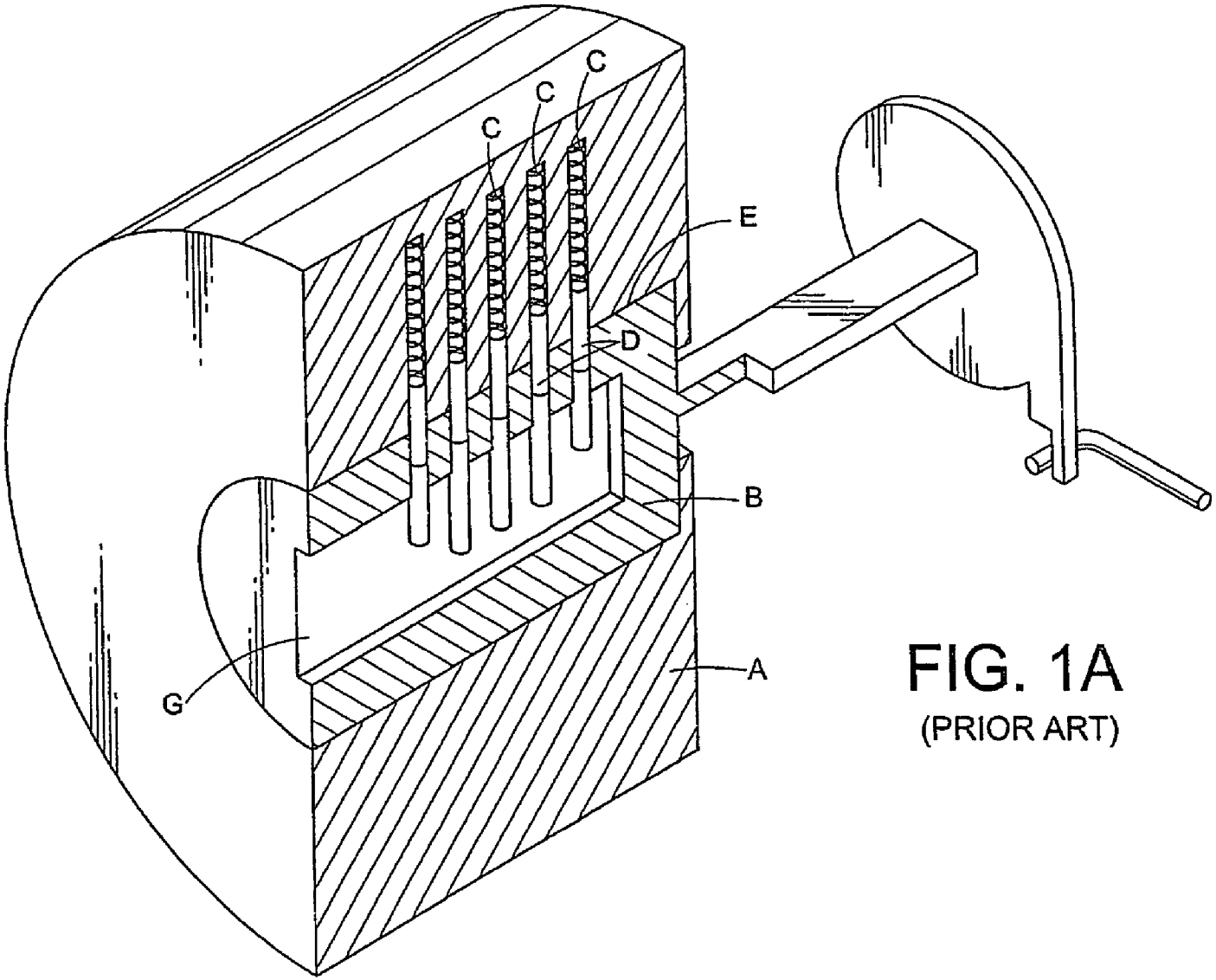
FIG. 1A (PRIOR ART)
FIGS. 1A–1G are cross-sectional views of a conventional locking mechanism illustrating a typical lock picking technique.
Figure 1B:
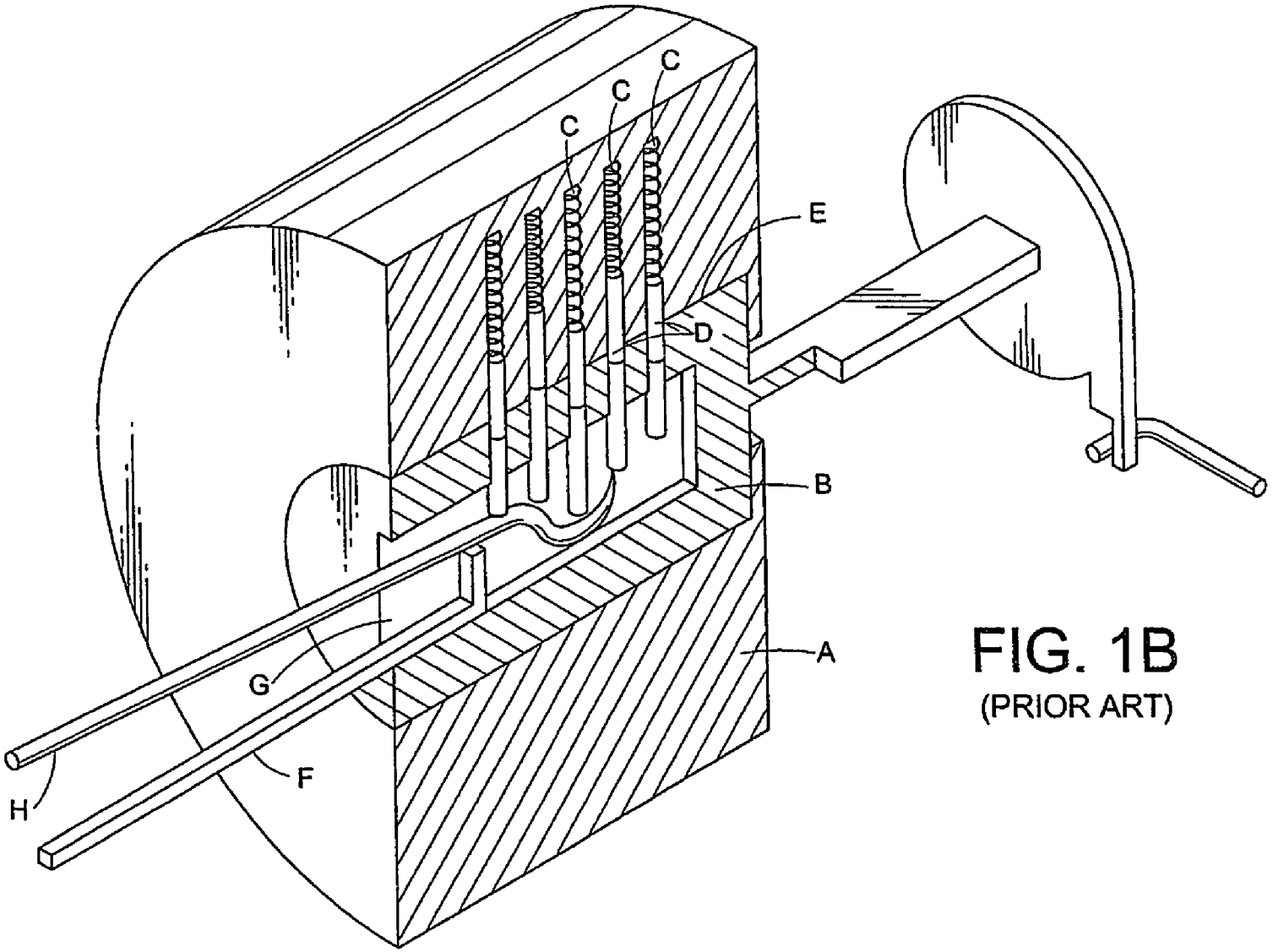
FIG. 1B (PRIOR ART)
Figure 1C:
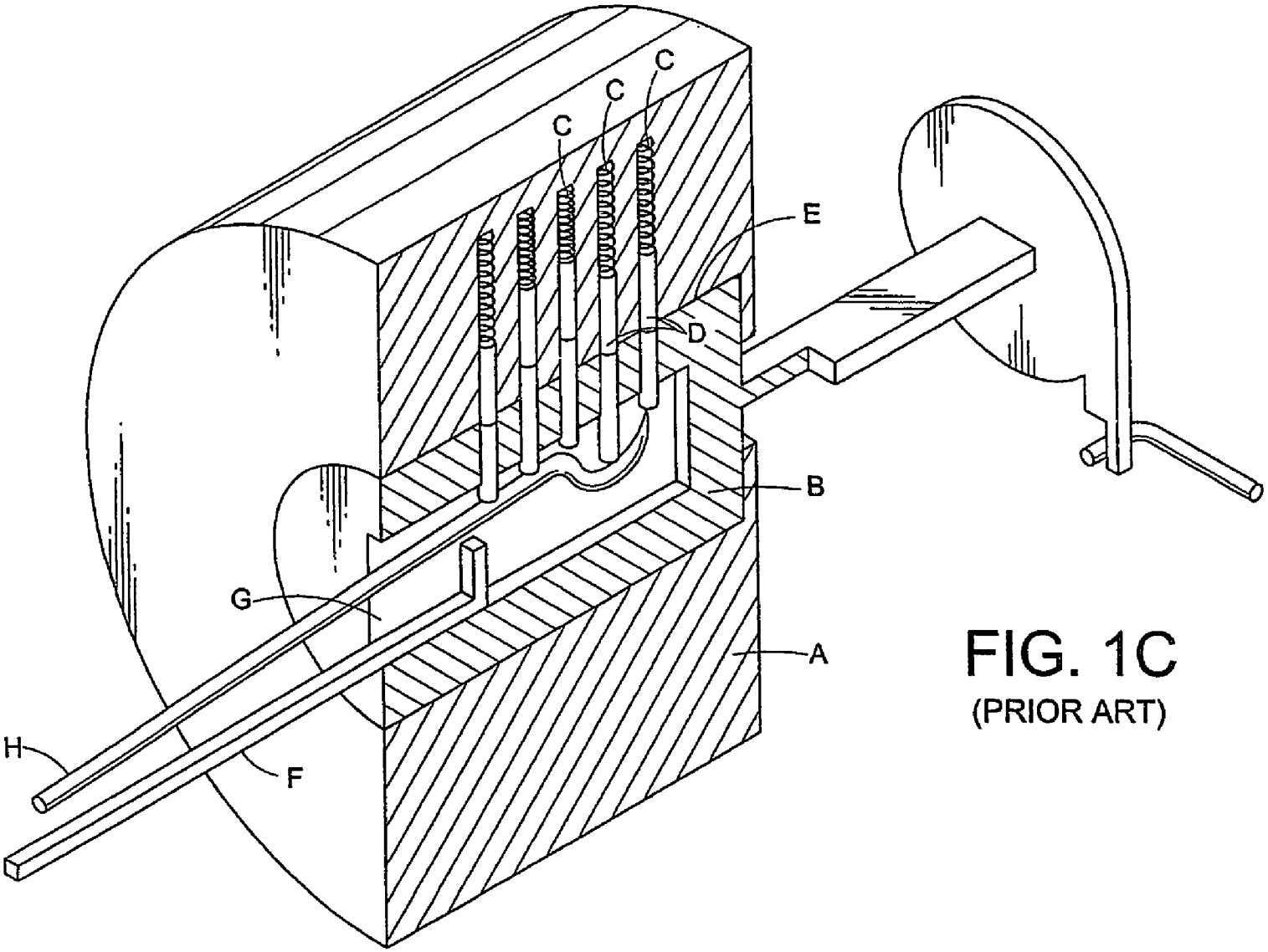
FIG. 1C (PRIOR ART)
Figure 1D:
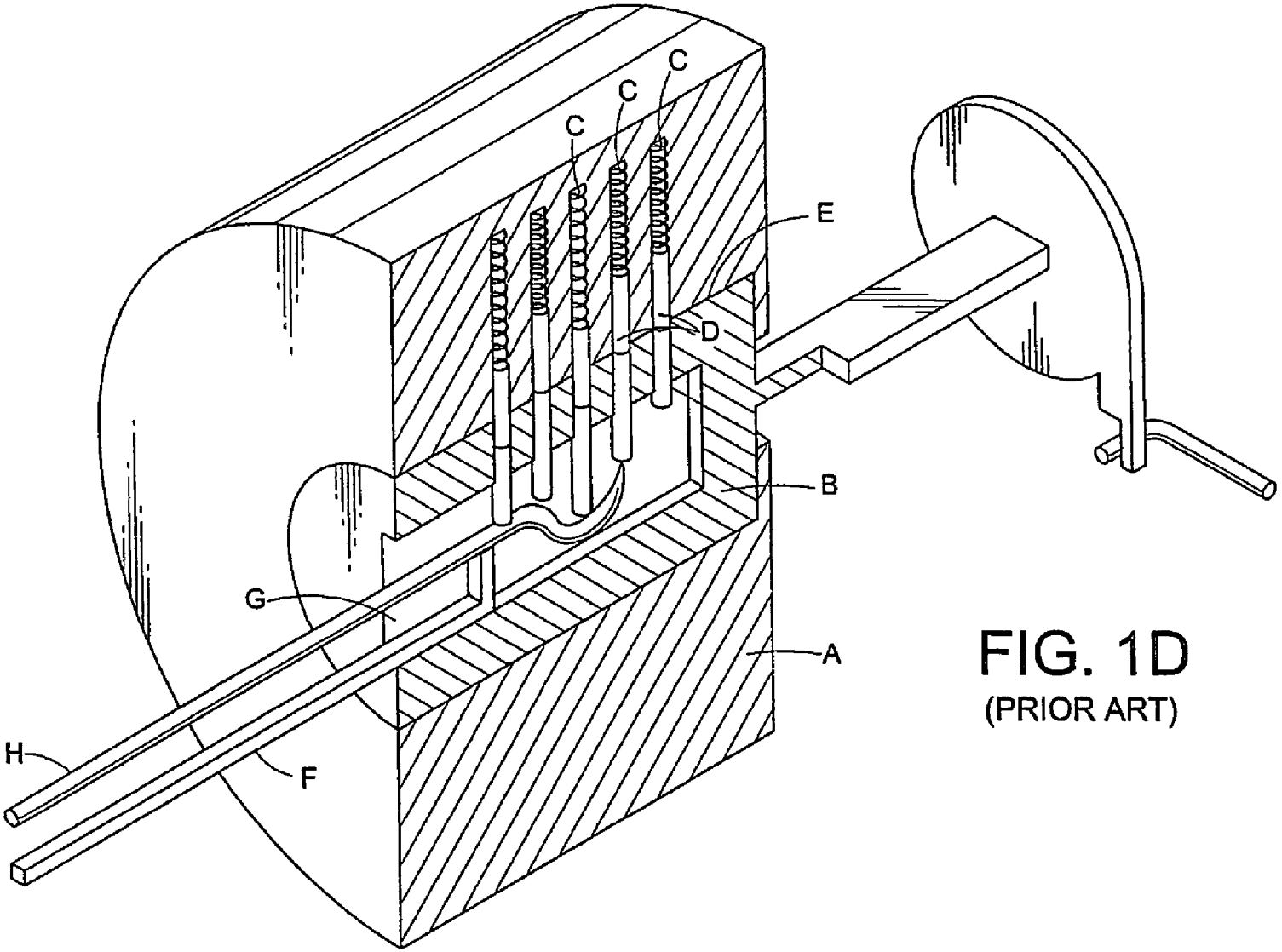
FIG. 1D (PRIOR ART)
Figure 1E:
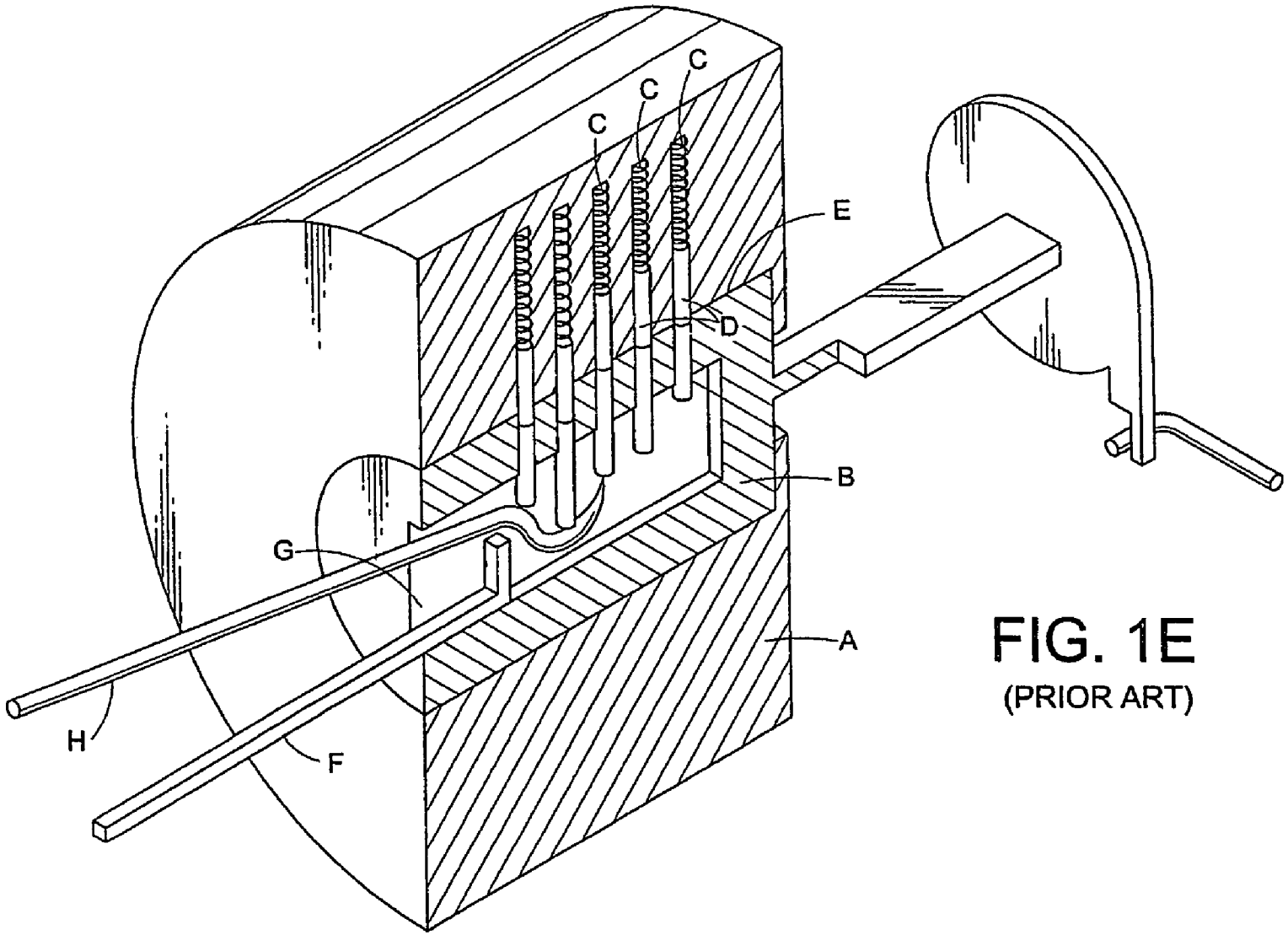
FIG. 1E (PRIOR ART)
Figure 1F:
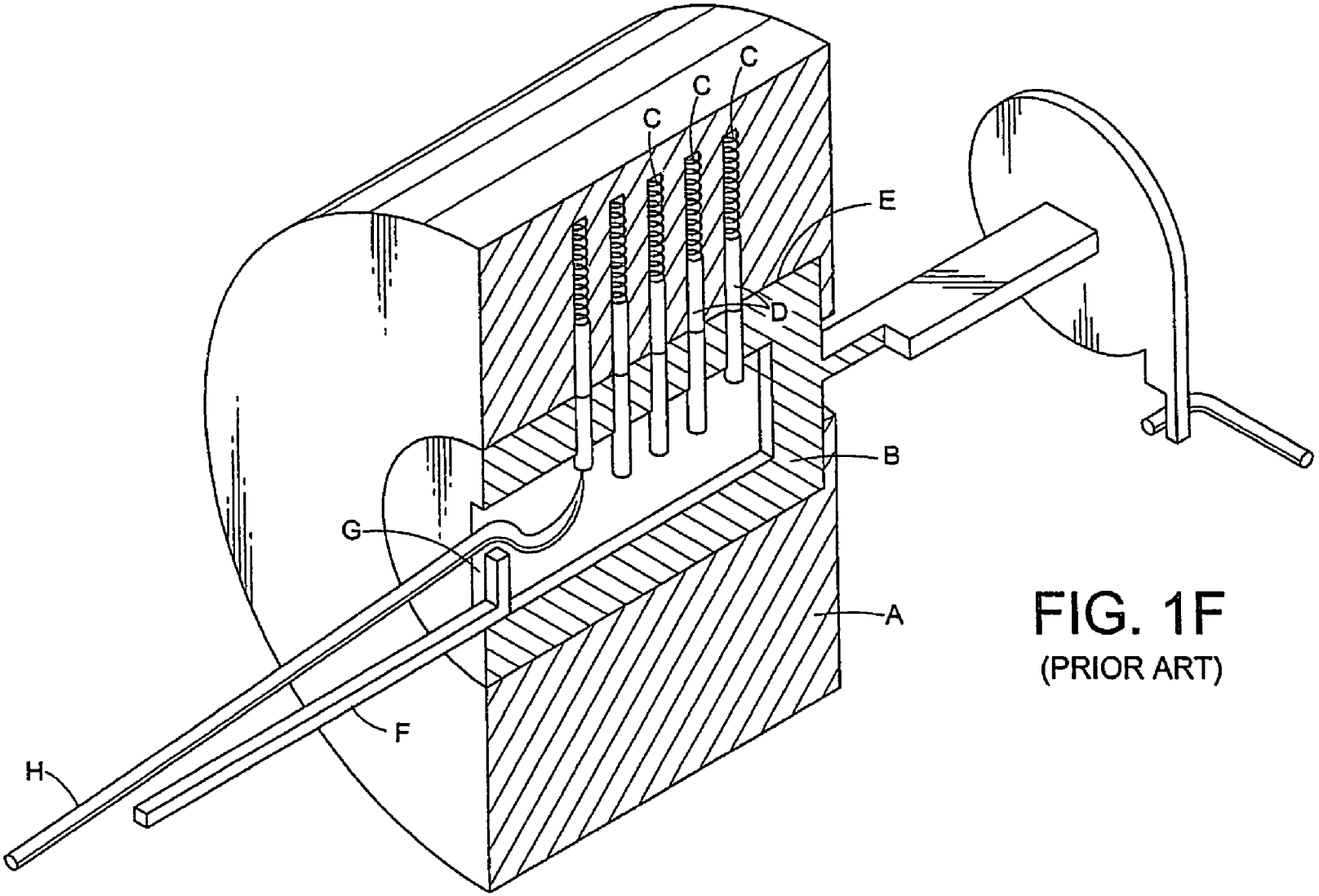
FIG. 1F (PRIOR ART)
Figure 1G:
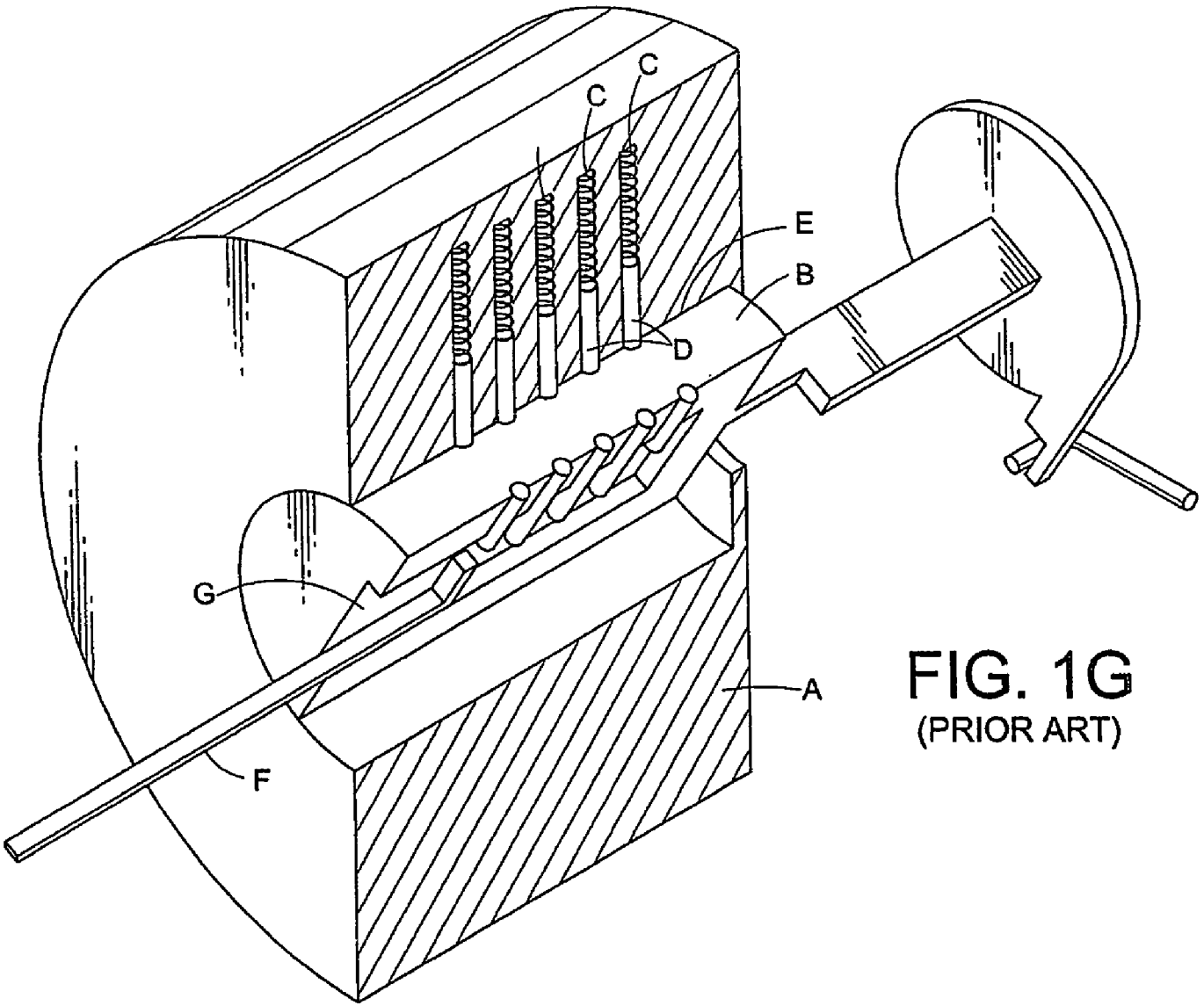
FIG. 1G (PRIOR ART)
Figure 2:
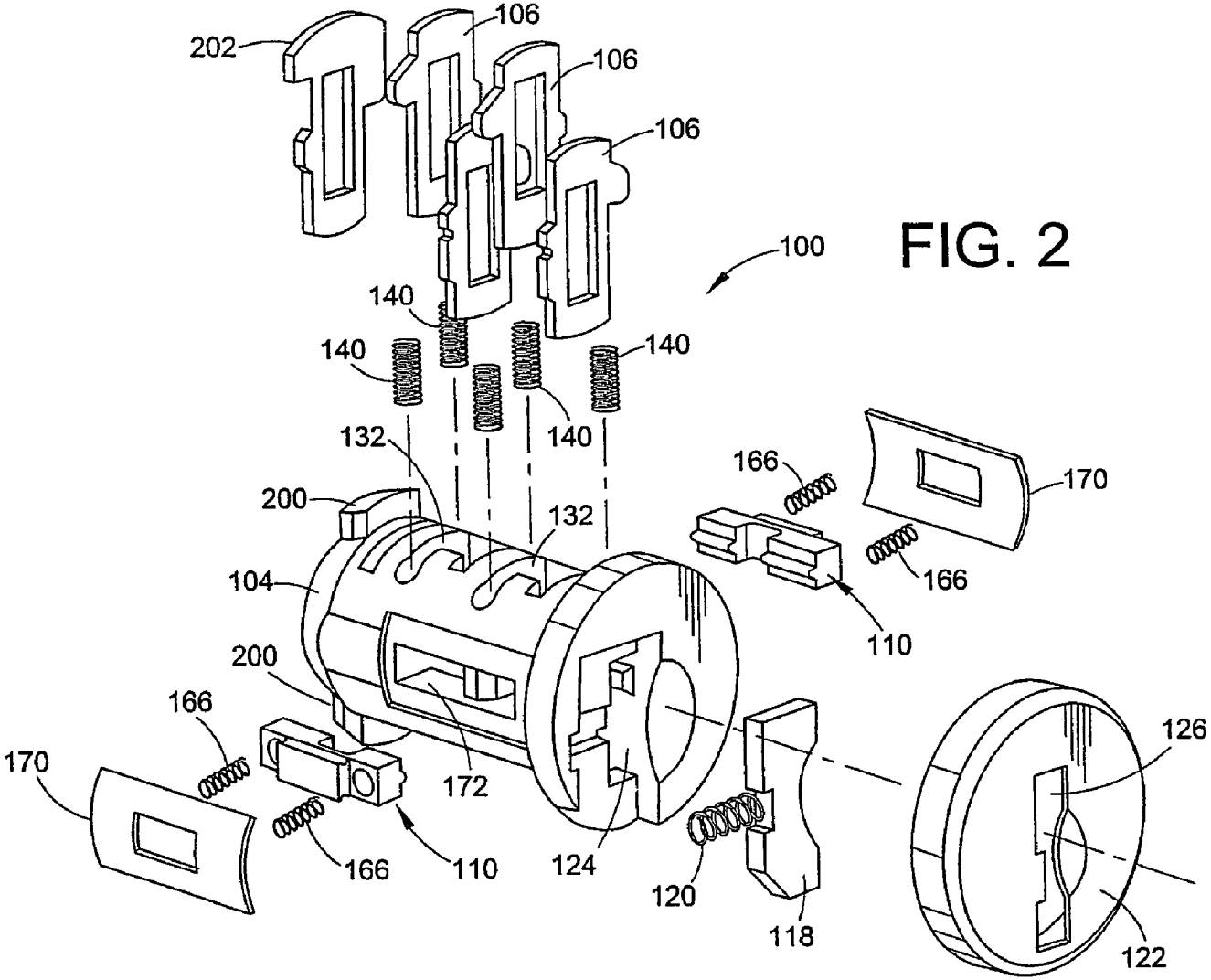
FIG. 2 is an exploded view of the wafer lock of the present invention.
Figure 3:
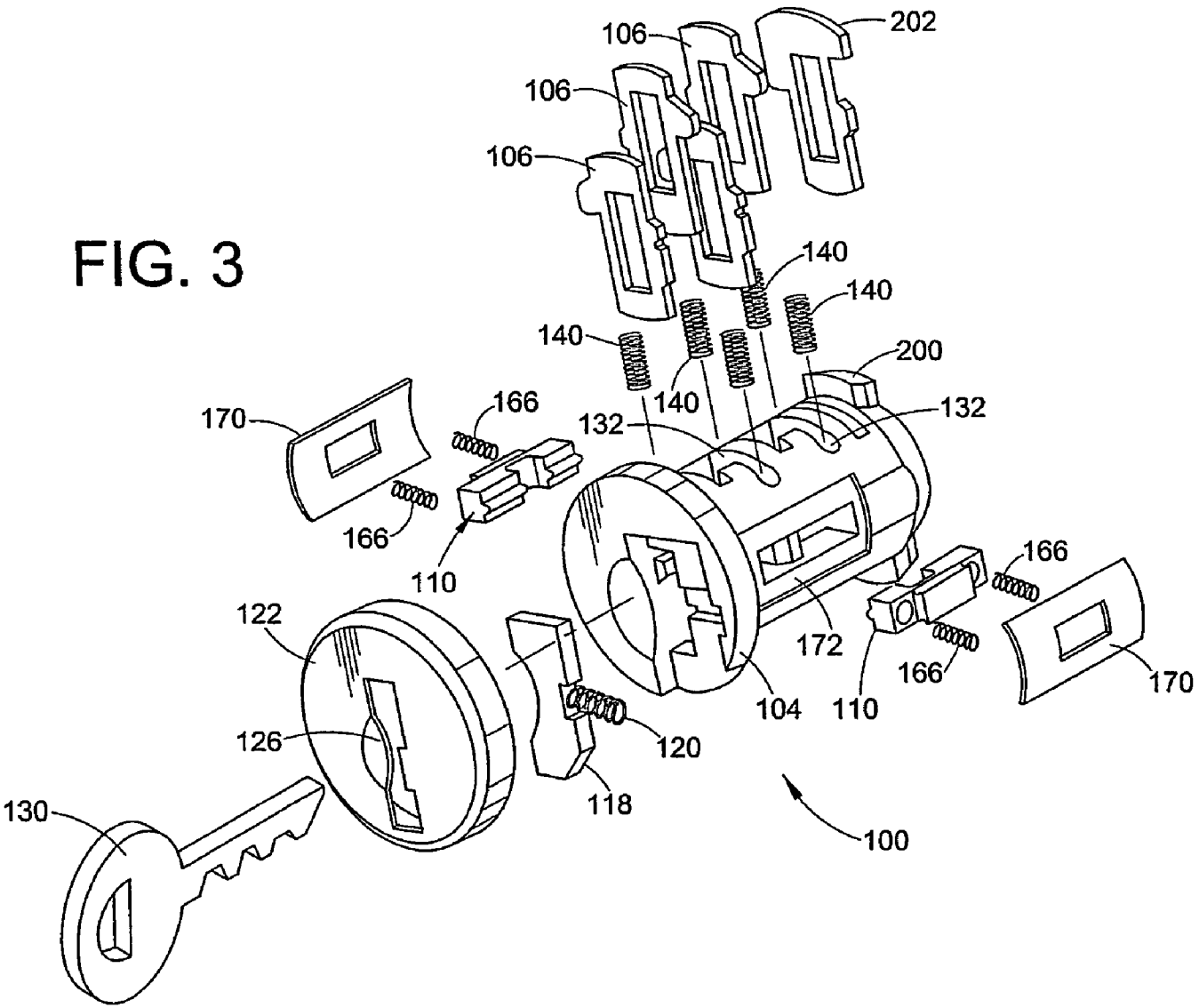
FIG. 3 is a view of the wafer lock of the present invention.

The present invention is a wafer tumbler locking mechanism, generally referenced as 100, including a lock body, lock housing or shell 102, a lock cylinder 104, a set of spring-loaded wafer tumblers 106 and a set of spring-loaded sidebars 110. Optionally, the wafer lock may also include a cylinder door 118, cylinder door spring 120 and cylinder cap 122 which assemble into a cylinder plug 104 front opening 124. The cylinder cap 122 contains an opening 126 into which a key 130 is inserted.

Figure 4:
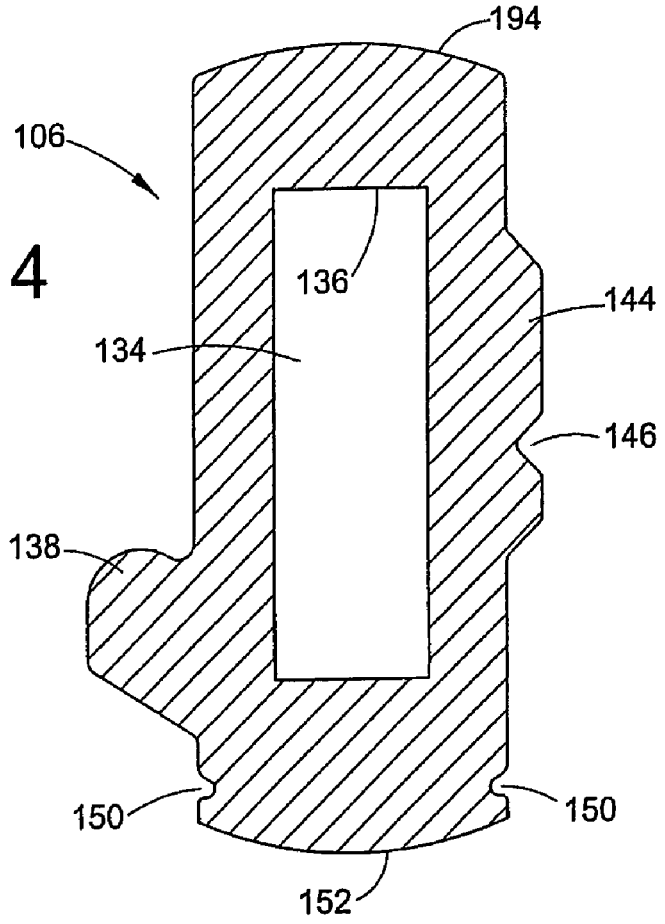
FIG. 4 is a front view of a wafer tumbler of the wafer lock.

As shown in FIG. 4, the wafer tumblers 106 are generally flat rectangular-shaped pieces that are arranged within a set of tumbler slots 132. While the wafer tumblers 106 are shown and described as flat, generally rectangular pieces, it should be appreciated that the wafer tumblers 106 can be a variety of shapes, sizes and configurations providing the wafer tumblers 106 still provide the functional aspects as described herein. Each wafer tumbler 106 has an opening 134 through the center of the tumbler though which a key 130 is inserted. These openings 134 are configured to mate with a key 130 such that when a key 130 is inserted through the keyway 131 and the openings 134 the notches in the key contact the upper edge 136 of the tumbler opening and thereby move the tumbler 106, as discussed in further detail below.

Each wafer tumbler 106 has a spring tab 138 that protrudes from one side of the wafer tumbler 106 and contacts one end of the spring 140. The other end of the spring 140 contacts a surface 142 of the cylinder 104, thereby biasing the wafer tumbler 106 into engagement with the shell 102 as discussed below.

The wafer tumbler 106 also has a sidebar tab 144 protruding from the opposite side of the wafer tumbler 106 from the spring tab 138. The sidebar tab 144 includes cutout 146 for engaging the sidebar 110. While the cutout 146 is shown as a pointed recess within the sidebar tab 144, it should be appreciated that cutout 146 may also be rounded or contain different types of surfaces; however the cutout 146 should be configured to provide solid mating engagement with the sidebar 110. The wafer tumbler sidebar tab 146 may contact a sidebar 110 at a geometrically inversed projection 148 located on the sidebar 110. The projection 148 is used to maintain contact between the sidebar tab 144 and the sidebar 110. Wafer tumblers 106 may further include indentations 150 in one end of the tumbler 106 that form a camming surface with the lock shell 102. The indentations 150 are generally located along the bottom 152 of the wafer tumbler 106 which engages the lock shell 102 when the wafer tumbler 106 is in the locked position, as discussed below.

Figure 5:
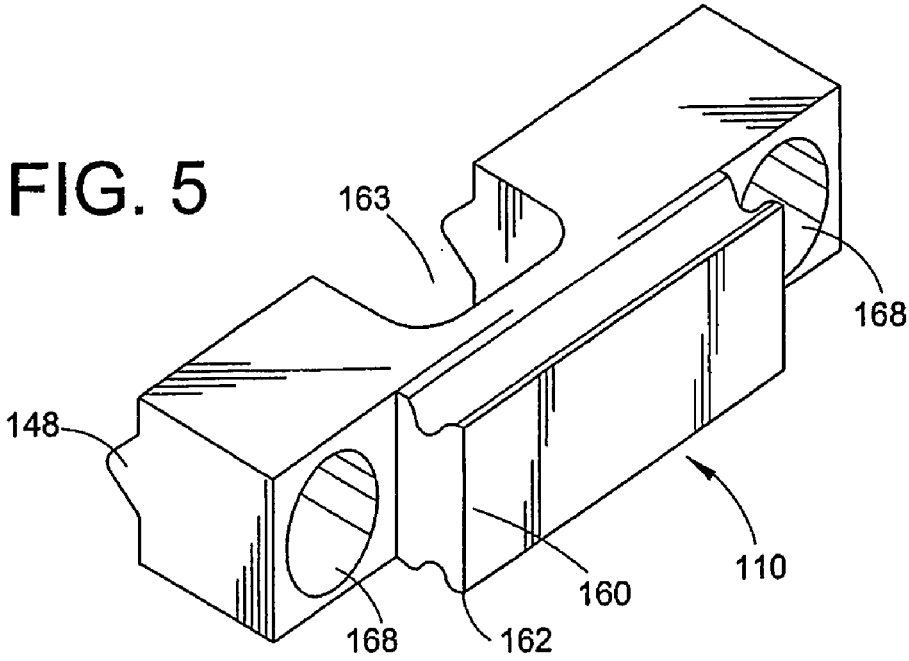
FIG. 5 is a view of a sidebar of the wafer lock.

The sidebars 110, shown in detail in FIG. 5, are rectangular with a projection 160 with beveled sides 162 that forms a camming surface with the interior of the shell 102. The length of the sidebars 110 depend on the number of wafer tumblers 106 the sidebar interacts with. In one embodiment, the sidebars 110 are long enough to engages the two or more wafer tumblers 106 in every other fashion. While the wafer tumbler to sidebar ratio may be 1:1, it is preferable to have such ratio be 2:1, or greater, to further provide anti-picking protection. The sidebar 110 has a sidebar recess 163 which spans the area where the wafer tumbler spring 140 of the intervening wafer tumbler 106 is located. The sidebar 110 has a tumbler projection 148, located on either side of the recess 163, which contacts non-adjacent wafer tumblers 106. As mentioned above, the projection 148 contacts The sidebar tab 144 of the wafer tumbler 106 at due sidebar tab cutout 146. This wafer tumbler sidebar tab cutout 146 is located at various positions along the wafer tumbler sidebar tab 144. Each different position is aligned with the sidebar projection 160 by the notches on the key 130 at a different depth. As described above, contact between the tumbler projection of the sidebar and the wafer tumbler determines whether the sidebar is in a position of interference or non-interference with the lock shell. The separation of the sidebar 110 into two portions with the sidebar projection 160 between them allows a rocking or pivoting motion in the sidebar 110 that decreases the ability to of the sidebar 110 to seat in the sidebar cutouts 146 of both wafer tumblers 104 simultaneously unless positioned by a key 130. The sidebar is held in place within the cylinder shell by sidebar springs 166, one end of which contacts the sidebar 110 at the blind hole 168 located at each end of the sidebar 110.

The wafer tumblers 106 and sidebars 110 fit into a cylinder plug 104, the wafer tumblers 106 generally located in the center of the cylinder plug 104 located in wafer slots 132, and the sidebars located between the wafer tumblers 106 and the lock shell 102. Optionally, a set of sidebar mounting plates 170 can be used to position the sidebars 110 into position between the wafer tumblers 106 and lock shell 102. The sidebars 110 are placed in the sidebar slots 172 located between the wafer tumblers 106 and the lock shell 102.

The lock shell 102 includes a top cavity 180, two side cavities 182, and a bottom cavity 184. Each of the shell cavities have a set of projections that act as camming surface to prohibit rotation of the lock cylinder. Specifically, the top cavity 180 has a set of top projections 186, the side cavities 182 have a set of side projections 188, and the bottom cavity has a set of bottom projections 190. As assembled, and in the looked position, both the tumblers 106 and the sidebars 110 extend from the cylinder assembly 100 into cavities in the lock shell 102. So positioned, the tumblers 106 and sidebars 110 are in a position of interference with the lock shell 102, preventing rotation of the cylinder assembly 100 within the lock shell 102. When rotational torque is applied to the cylinder assembly 100 in the absence of the correct key, camming of the projections 160 of the sidebars with projections 188 adjacent to side cavities 182 in the interior sides of the lock shell 102 results in pulling of the sidebars 110 farther into the shell side cavity 182 thereby locking the sidebars 110 in a position of interference with the shell 102. Likewise, rotational torque, in the absence of the correct key, camming of indentations 150 of the wafer tumblers 106 with projections 190 of the lock shell 102 adjacent to top cavity 180 or the bottom cavity 184 of the lock shell 102 results in pulling of the wafer tumblers 106 farther into the shell top cavity 108 or shell bottom cavity 184 and locking the wafer tumblers 106 therein in a position of interference with the shell 102. Additionally, to further prohibit rotation of the cylinder 104, the tolerance between the sidebars 110 and the lock shell 102 may be less than the tolerance between the wafer tumblers 106 and the shell 102. Therefore, when rotational torque is applied to the cylinder assembly 100 in the absence of the correct key 130, the beveled sides 162 of the sidebars 110 engage with the lock shell 102 before the indentations 150 of the wafer tumblers 106 engage with the lock shell 102. This feature prevents positioning of the wafer tumblers 106 in a position of non-interference by resting the ends of the tumblers 106 on the ledge of the shell 102 along the shear line. Furthermore, the spring force exerted by springs 140, which hold the wafer tumblers 106 in position, may be greater than the spring force exerted by springs 166, which hold the sidebars 110 in position. Providing a greater spring force on springs 140, as compared to springs 166, prevents the use of the sidebars 110 as a means for maintaining the wafer tumblers 106 in position of non-interference. As such if a wafer tumbler 106 was moved to a position wherein it no longer interferes with the shell 102 in bottom shell cavity 184, and therefore allowing the sidebar 110 to move into position against the sidebar tab 144 of the wafer tumbler wherein the sidebar 110 moves to a position wherein it no longer interferes with the shell 102 in the side cavity 182, the spring force exerted by spring 140 would overcome the spring force exerted by spring 166 and the wafer tumbler 106 would spring back into bottom cavity 184 of the shell 102.

Figure 6:
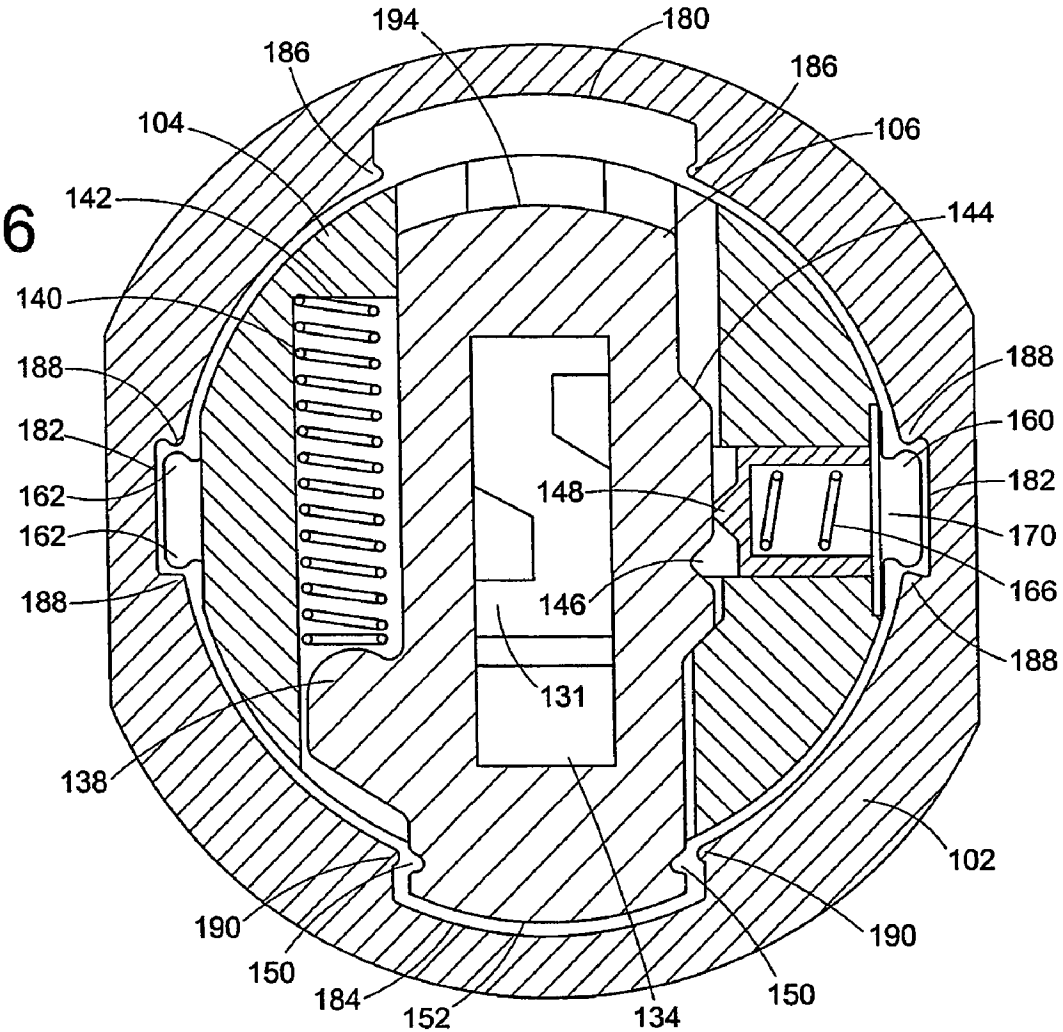
FIG. 6 is cross-sectional view of the cylinder assembly and shell of the wafer lock.

As shown, both the wafer tumbler 106 and the sidebar 110 are in a position of interference with the shell 102. Therefore, the locking mechanism is in the locked position. The cross-sectional view of FIG. 5 shows the wafer tumbler 106 assembled into the cylinder plug wafer slot 132 of the cylinder plug 104 with the wafer tumbler spring 140. The wafer tumbler spring 140 holds the wafer tumbler 106 in a position of interference with the shell 102, as shown by the wafer tumbler bottom end 152 positioned into the shell bottom cavity 184. The sidebar pointed projection 148 of the sidebar 110 contacts with the wafer tumbler sidebar tab 144 of the sidebar 110. The sidebar spring 166 pushes against the sidebar 110 to continually force the sidebar 110 toward the wafer tumbler 106. When the wafer tumbler sidebar cutout 146 is not aligned with the sidebar projection 148, as shown in FIG. 6, the sidebar projection 160 extends into the shell side cavity 182 to prevent rotation of the cylinder plug 102.

When rotational torque is applied to the interchangeable cylinder assembly 100, by an incorrect key for example, the interchangeable cylinder assembly 100 will not rotate due to the interference between the shell 102 and the wafer tumblers 106 and the sidebars 110. When rotational torque is applied to the locking mechanism, without use of the correct key, the beveled side of sidebar projection 162 contacts and cams with the shell side projection 188 and pulls the sidebar projection 160 into the shell side cavity 182. Additionally, when rotational torque is applied to the lock, in the absence of the correct key, the wafer tumbler shell indentations 150 engage with the shell bottom projections 190. This engagement prevents upward movement of the wafer tumbler 106 into a position of non-interference. To further prevent the possible picking of the lock, the tolerance between the sidebars 110 and the shell 102 may be less than the tolerance between the wafer tumblers 106 and the shell 102. Therefore, when rotational torque is applied in absence of the correct key, the sidebar projection 160 engages with the shell 102 before the wafer tumbler 106 engages with the shell 102. Since the wafer tumbler 106 fails to contact the shell 102, it is not possible to wedge the wafer tumbler 106 into a position along a ledge that is created along the shear line, as is attempted when the lock is picked.

If the correct key 130 is inserted into the keyway 131 of the interchangeable cylinder assembly 100, the cuts on the key will position the wafer tumbler 106 within the cylinder plug 104 so that the ends of the wafer tumbler 106, the wafer tumbler top end 194 and the wafer tumbler bottom end 152, become flush with the outside diameter of the cylinder plug 104 and, at the same time, align the wafer tumbler sidebar cutout 146 with the sidebar pointed projection 148. When the sidebar pointed projection 148 is aligned with the wafer tumbler sidebar cutout 146, the sidebar 110 moves inward until the beveled side of sidebar projection 162 is also flush with the outside diameter of cylinder plug 104. At that point, rotational torque applied to the key 130 causes the cylinder plug 104 to rotate within the shell 102, thereby unlocking the wafer tumbler locking mechanism.

Locking mechanisms are contemplated that have between 4 and 11 wafer tumblers 106 and between 2 and 5 sidebars 110. If the locking mechanism also comprises the interchangeability feature, whereby one interchangeable cylinder assembly 100 can be removed from the lock shell 102 and replaced with another interchangeable cylinder assembly 102 for the purposes of re-keying the lock, then an additional tumbler, called a shell locking tumbler 202 is used in the design.

FIGS. 7, 8, 9 and 10 are views of the interchangeable cylinder assembly 100 and surrounding lock shell 102.

Figure 7:
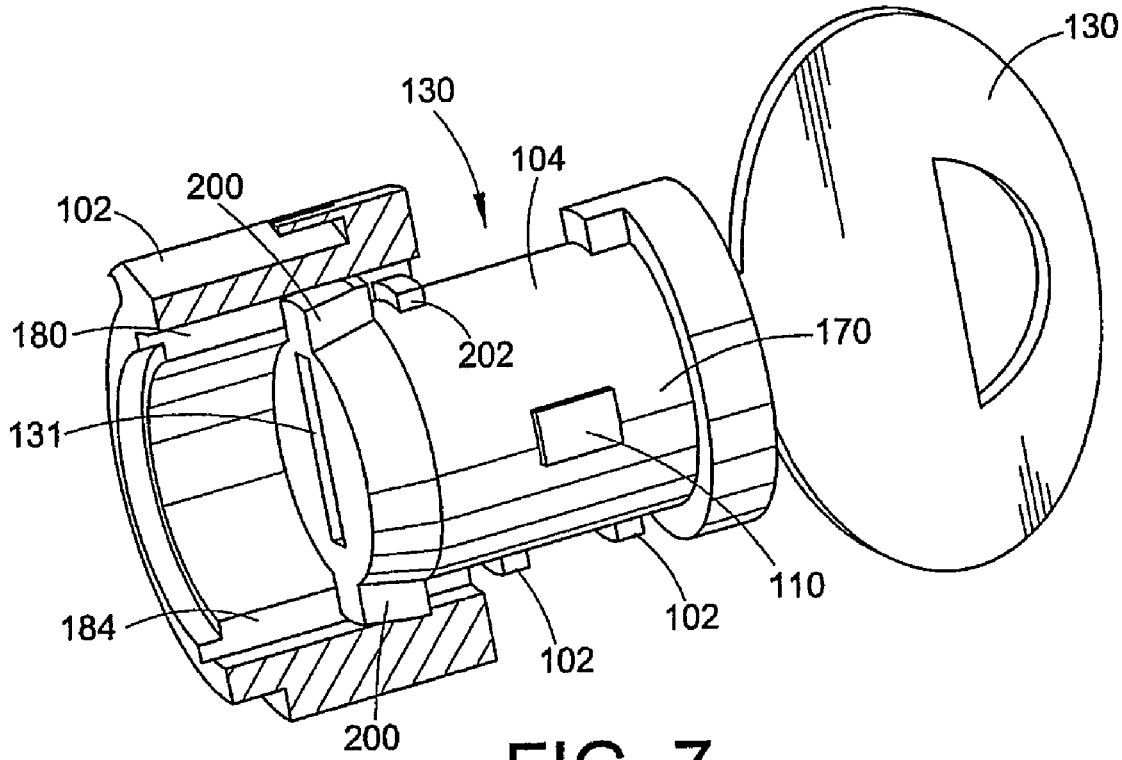
FIG. 7 is a cross-sectional view of the interchangeable cylinder assembly partially inserted into the shell.
Figure 8:
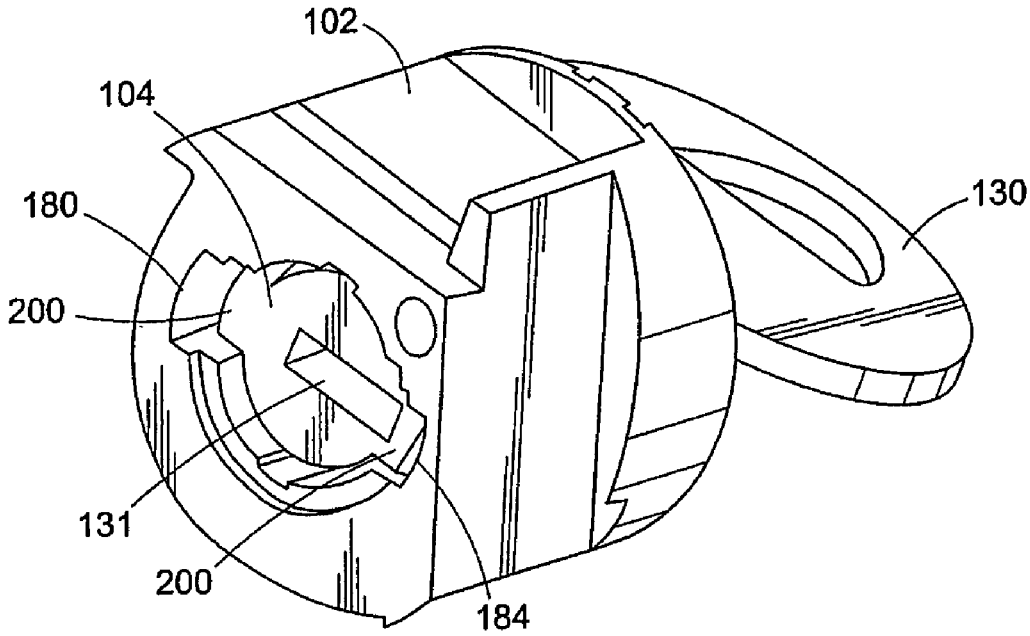
FIG. 8 is a view of the interchangeable cylinder assembly partially inserted into the shell.
Figure 11:
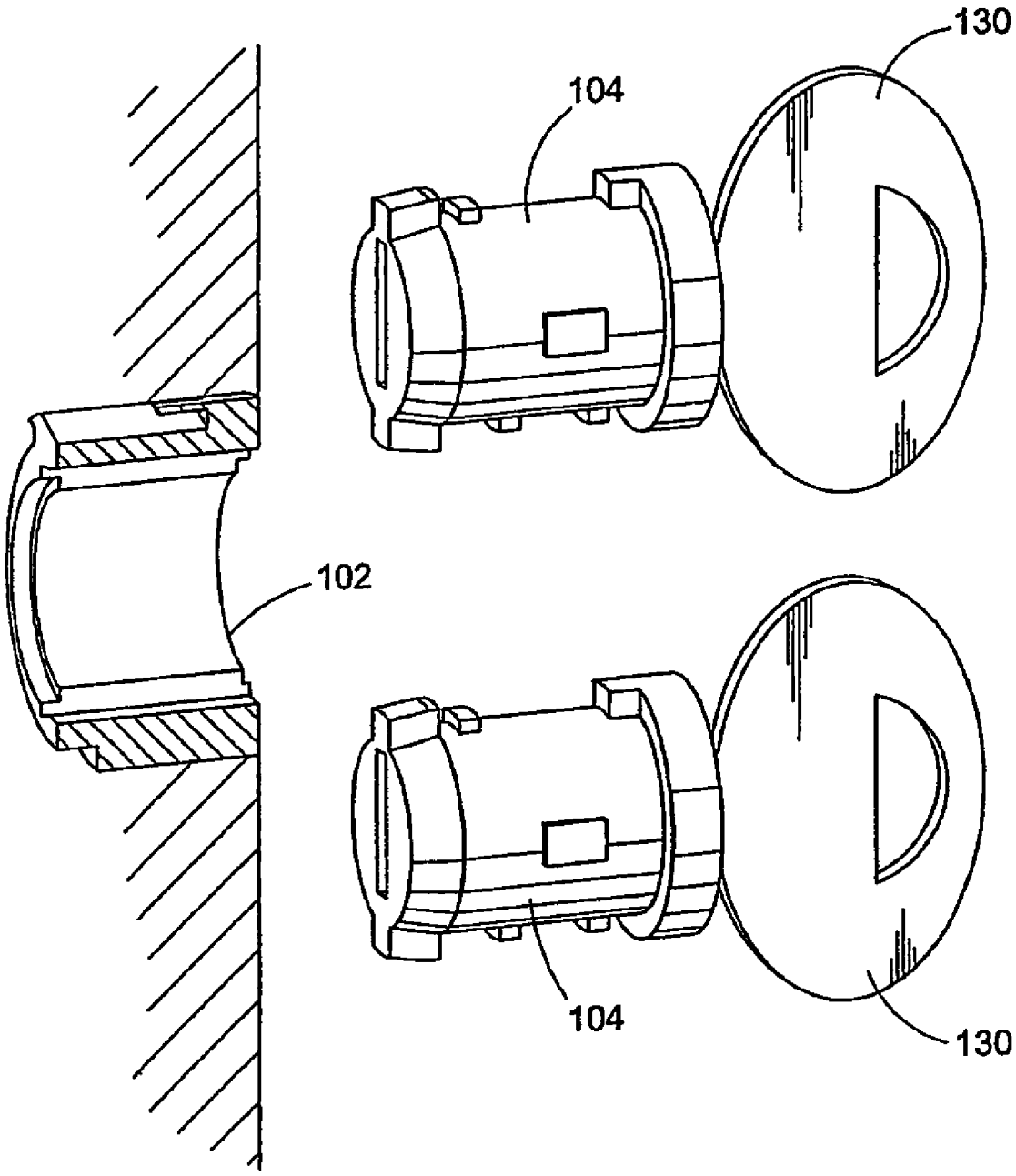
FIG. 11 illustrates the multi-cylinder locking assembly of the present invention.

These figures particularly show the features of the interchangeable cylinder feature of the lock. FIG. 7 is a cross-sectional view of the interchangeable cylinder assembly 100 in the unlocked position and partially inserted into the shell 102. The cylinder plug retainer lugs 200 are aligned and inserted into the shell through the wafer cavities 180 and 184. The interchangeable cylinder assembly 100 is inserted into the shell 102 in the direction of the arrow. Also shown is a shell locking tumbler 202 which is a single wafer at the end of the cylinder plug 104 that is nearest to the cylinder plug retainer lugs 200. The shell locking tumbler 202 locks the interchangeable cylinder assembly 100 into the shell 102 after it has been completely inserted therein. FIG. 7 shows a rear view of the interchangeable cylinder assembly 100 being inserted into the shell 102. In this view, the interchangeable cylinder assembly 100 has been almost pushed all the way into the shell 102. The cylinder plug retainer lugs 200 are shown aligned with the wafer cavities 180 and 184. FIG. 8 shows a view of the interchangeable cylinder assembly 100 partially inserted. Once completely inserted, the interchangeable cylinder assembly 100 is rotated such that the cylinder plug retainer lugs 200 are offset from wafer cavities 180 and 184. In this position, the interchangeable cylinder assembly 100 cannot be pulled out of the shell 102 without rotating the interchangeable cylinder assembly 100 back to a position where the cylinder plug retainer lugs 200 align with wafer cavities 180 and 184 in the shell 102. Once the interchangeable cylinder assembly 100 is positioned within the shell 102 as shown in FIG. 9, a special key can be inserted into the keyway 131 of the lock, causing retraction of the shell locking tumbler 202 into the lock cylinder plug 104. In this position, the interchangeable cylinder assembly 100 can be removed from the shell 102 of the lock.

An additional feature of the lock is that the cylinder assembly 100 is easily removable from the lock shell 102 and replaceable with a different cylinder assembly 100 for the purpose of re-keying the lock. The cylinder plug 104 has cylinder plug retainer lugs 200 at the end opposite from the end where the key 130 is inserted. These retainer lugs 200 are important to the interchangeability of the interchangeable cylinder assembly 100 as they are different widths and will only allow the cylinder plug to be removed with a certain orientation. The interchangeable cylinder assembly 100 can easily be removed from the shell 102 and a different interchangeable cylinder assembly 100 can be inserted. The interchangeable cylinder assembly 100 is locked into place within the shell 102 by a shell locking tumbler 202. This interchangeability feature allows rapid re-keying of the lock.

What is claimed is:

1. A locking mechanism comprising:

a lock housing;

a lock cylinder having a keyway therein and rotateably disposed within said lock housing;

a plurality of spring loaded tumblers disposed with said lock cylinder; and two or more spring-loaded sidebars disposed within said lock cylinder and engaging said tumblers, wherein the sidebars have a projection with beveled sides forming a camming surface with the lock housing, and wherein each sidebar contacts only non-adjacent tumblers;

wherein said sidebars further comprise a recess wherein a tumbler spring is contained.

2. The locking mechanism of claim 1, wherein the tumblers are selectively engageable with a first cavity within the lock housing.

3. The locking mechanism of claim 2, wherein the sidebars are selectively engageable with a second cavity within the lock housing.

4. The locking mechanism of claim 3, wherein the tolerance between the sidebars and the lock housing is less than the tolerance between the tumblers and the lock housing.

5. The locking mechanism of claim 1, wherein the ratio of tumblers to sidebars is at least 2:1.

6. The locking mechanism of claim 5, comprising four tumblers and two sidebars.

7. The locking mechanism of claim 1, wherein the tumblers have indentations that form a camming surface with a second cavity of the lock housing and said housing includes one or more projections for engagement with said tumbler camming surface.

8. The locking mechanism of claim 1, further comprising a first lock housing cavity comprising one or more projections for engaging said beveled sides of said sidebar projection.

9. The locking mechanism of claim 1, wherein the spring force exerted on said tumblers is greater than the spring force exerted on said sidebars.

10. A locking mechanism comprising:

a shell;

a lock cylinder having a keyway therein and rotateably disposed within said shell;

a plurality of spring-loaded tumblers contained within said lock cylinder and selectively engageable with said shell; and two or more spring-loaded sidebars positioned between said spring-loaded tumblers and the shell and selectively engageable with said shell and engages said tumblers, wherein each sidebar has a projection with one or more beveled surfaces that forms a camming surface with a first cavity within the lock shell, wherein each of said two or more sidebars includes a recess where a tumbler spring is contained.

* * * * *